US006536988B2

(12) United States Patent
Geiger

(10) Patent No.: US 6,536,988 B2
(45) Date of Patent: Mar. 25, 2003

(54) CONSTRUCTION KIT MADE OF CONCRETE PAVING STONES

(76) Inventor: Peter Geiger, Regensburger Str. 160, D-92318 Neumarkt (DE)

( * ) Notice: Subject to any disclaimer, the term of this patent is extended or adjusted under 35 U.S.C. 154(b) by 0 days.

(21) Appl. No.: 09/446,474

(22) PCT Filed: Apr. 22, 1998

(86) PCT No.: PCT/EP98/02389

§ 371 (c)(1),
(2), (4) Date: Dec. 21, 1999

(87) PCT Pub. No.: WO99/54552

PCT Pub. Date: Oct. 28, 1999

(65) Prior Publication Data

US 2002/0104283 A1 Aug. 8, 2002

(51) Int. Cl.[7] ..... E01C 5/00; E04C 2/04; E04B 5/04

(52) U.S. Cl. ..... 404/39; 404/17; 404/34; 404/37; 404/38; 404/42; 52/603; 52/604; 52/605

(58) Field of Search ..... 404/17, 34, 37, 404/38, 39, 41, 42; 52/603, 604, 605; D25/113

(56) References Cited

U.S. PATENT DOCUMENTS

| | | | | | |
|---|---|---|---|---|---|
| 929,366 | A | * | 7/1909 | Alcott | 404/17 |
| 1,045,328 | A | * | 11/1912 | Sammis | 404/41 |
| 1,689,107 | A | * | 10/1928 | Bradley | 52/592.3 |
| 1,969,729 | A | * | 8/1934 | Damianik | 404/17 |
| 3,229,439 | A | * | 1/1966 | Strobel | 404/17 |
| 4,627,764 | A | * | 12/1986 | Scheiwiller | 404/41 |
| 4,761,095 | A | * | 8/1988 | Bartlechner | 404/41 |
| 4,792,257 | A | | 12/1988 | Rinninger | |
| 4,907,909 | A | * | 3/1990 | Ruckstuhl | 404/37 |
| 5,028,167 | A | * | 7/1991 | Scheiwiller | 404/41 |
| 5,211,895 | A | * | 5/1993 | Jacklich, Sr. | 264/71 |
| 5,348,417 | A | * | 9/1994 | Scheiwiller | 404/41 |
| 5,797,698 | A | * | 8/1998 | Barth et al. | 404/39 |
| 6,015,243 | A | * | 1/2000 | Geiger | 404/38 |
| 6,073,411 | A | * | 6/2000 | Ciccarello | 52/589.1 |
| D442,703 | S | * | 5/2001 | Fifield | D25/113 |

FOREIGN PATENT DOCUMENTS

| | | |
|---|---|---|
| DE | 91 06 183 | 10/1991 |
| DE | 44 05 516 | 8/1995 |
| EP | 0 227 144 | 7/1987 |
| EP | 0 274 344 | 7/1988 |
| EP | 0 622 493 | 11/1994 |

* cited by examiner

*Primary Examiner*—Gary S. Hartmann
(74) *Attorney, Agent, or Firm*—Collard & Roe, P.C.

(57) ABSTRACT

The invention relates to a construction kit made of concrete paving stones comprising substantially prismatic stone bodies of a uniform height and upright lateral surfaces. A plurality of stone paving stones (2) arranged in rows and having the same width in addition to the same or different lengths can be placed manually or placed by means of a machine with continuous or offset joints in said joint areas. A plurality of rows of paving stones that are arranged next to each other in a parallel position is used to form a rectangular or square packet that can be placed using a machine. The paving stones (2) have side surfaces (4) which have head pieces (2') that are defined by a wavy line along part of their height and base pieces (2") in sections, comprising domed areas (5) or projections jutting out laterally in relation to the head pieces (2') extending along another part of their height. When the packets are assembled for placement in the vicinity of the end stones that make up a row of paving stones, they form a line of continuous joints or provide substantially winding-shaped joints (7) if so desired by replacing different sized end stones from adjacent packets that have been moved towards each other.

5 Claims, 8 Drawing Sheets

CONSTRUCTION KIT MADE OF CONCRETE PAVING STONES

BACKGROUND OF THE INVENTION

The invention relates to a construction kit with paving stones made of concrete material, with substantially prismatic shaped stone bodies having the same height and upright side surfaces.

It is known that when paving stones that are assembled in laying packets and are machine laid, these laid stones form through-extending joints in the joint areas of the placed packets. Such joints have an unfavorable effect on the visual appearance of the placed composite of stones.

The problem of the invention is to provide a construction kit of the type specified above which can be assembled with other construction kits to form laid composites with the help of machines, and which permits forming simple continuous or offset joints selectively between adjacent construction kits.

This problem is solved according to the invention by providing a number of paving stones having the same width and the same or different lengths. These paving stones are arranged in rows wherein a number of rows of paving stones arranged next to each other form a rectangular or square packet that can be laid using a machine. The stone bodies have side surfaces which have head pieces. These head pieces are defined by a wavy line along part of their height, and base pieces in sections, comprising domed areas or projections jutting out laterally and transversely beyond the head pieces. These base pieces extend along another part of their height, whereby the laying packets permit the formation of either a line of continuous joints or the formation of substantially meander shaped joints within the placed composite within the region of the end stones of the rows of paving stones. Meander shaped joints are formed by replacing end stones with different lengths from adjacent laying packets that have been moved toward each other. The laying packets as such can be shaped in single pieces due to their prismatic form, and they can be safely picked by machines and laid as a prismatic packet, whereby in the laid condition, it is possible to selectively form lines of continuous, through-extending joints. However, joints offset in the form of a meander can be formed by replacing row end stones with different lengths of adjacent laying packets. These meander-like joints result in a laid composite, which is closed within itself and visually coherent without showing the individual construction kits.

In an advantageous embodiment of the construction kit, the stones have a the head and/or base pieces with broken or rounded corners and/or edges to exclude or minimize the risk of breakage in these regions. This design assures that walking on the laid composite is possible without any obstructions.

It was found that it is advantageous, furthermore, if the top surfaces defining the limitation of the head pieces, which are the treads of the paving stones, are arched outwardly in a curved way. In this way, the paving stones impart the appearance of natural stones, and the laid composite has the visual appearance of some type of natural stone paving. The curves of paving stones with large surface areas, viewed from the top, are kept flatter, and the curves of paving stones having a small surface area viewed from the top, are provided with a more pronounced curvature.

Finally, the outward dome-like projection or attachments are arranged on the base pieces of the stone bodies. These attachments are arranged on the side surfaces of the base pieces with spacings between each other, and wherein the dome-like projections or attachments form support elements for adjacent stone bodies. The outward dome-like projections, or attachments, jointly with outward dome-lie projections or attachments of adjacent stone bodies create intermediate spaces in the joint areas that serve as water passage openings. The sizes of the cross sections of the water passage openings are substantially determined in this connection by the length and width of the domed areas or attachments, as well as by their spacings from each other, and by their number.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION

Figure 1:
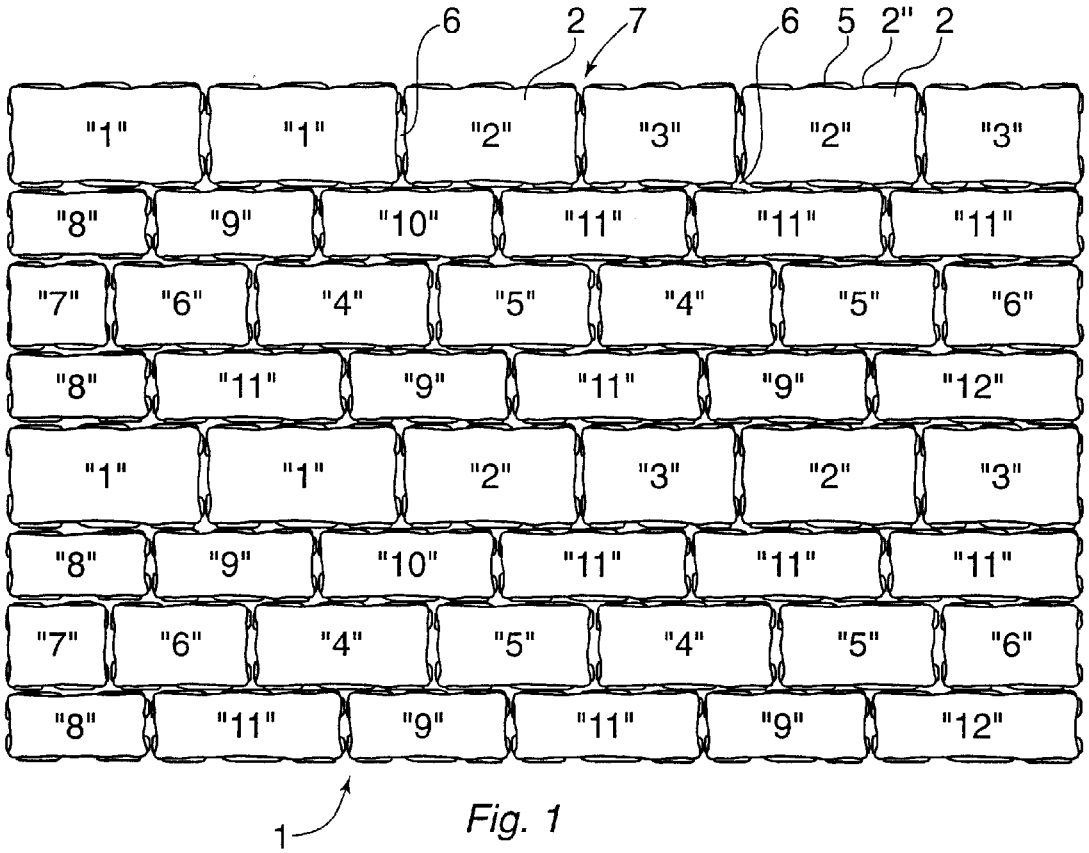
FIG. 1 is a top view of a construction kit.
Figure 2:
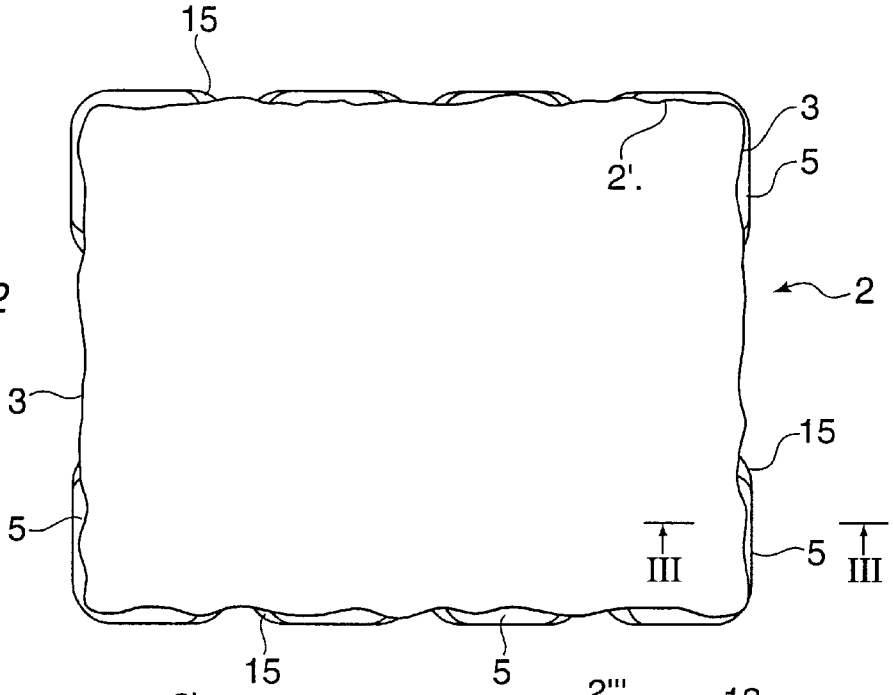
FIG. 2 is a top view of a paving stone of a construction kit according to one embodiment.
Figure 3:
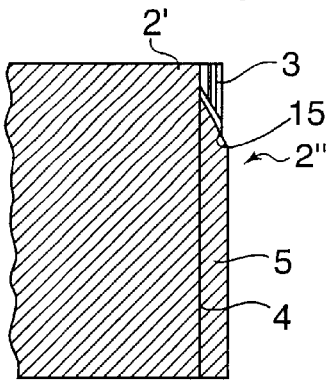
FIG. 3 is a part section according to line III—III in FIG. 2.
Figure 7:
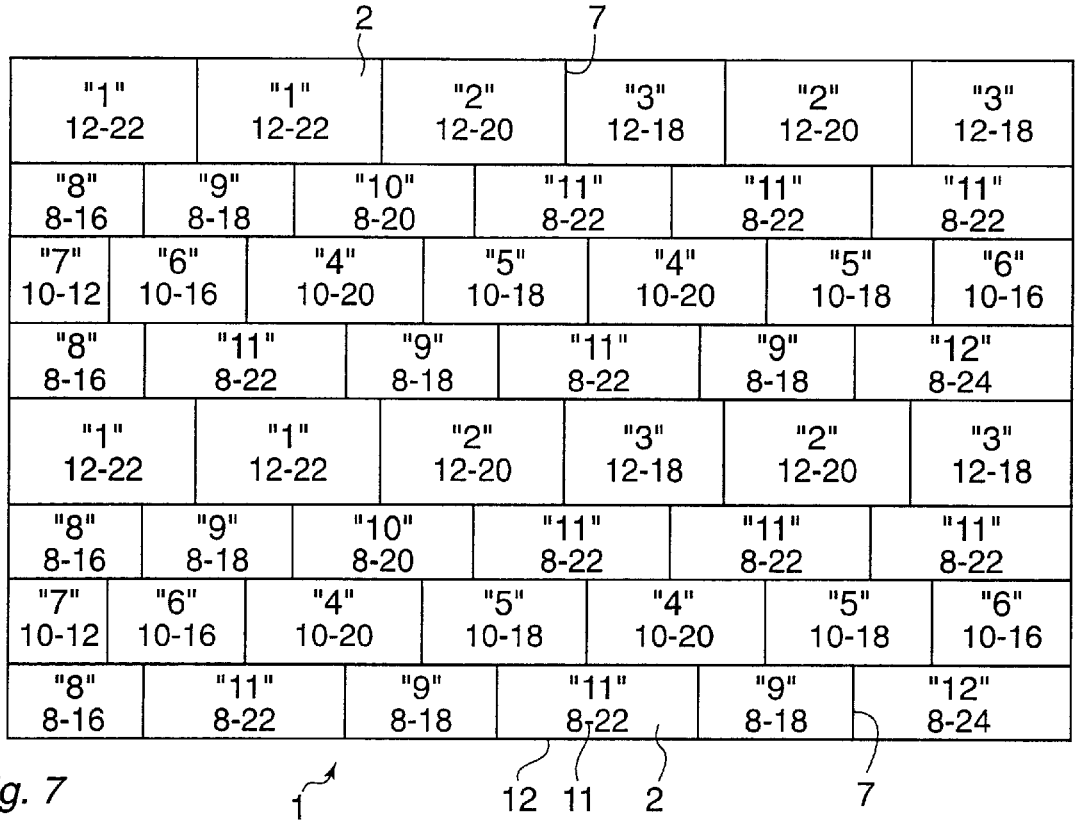
FIG. 7 is a construction kit according to FIG. 1 viewed from the bottom (core concrete side), schematic view.
Figure 8:
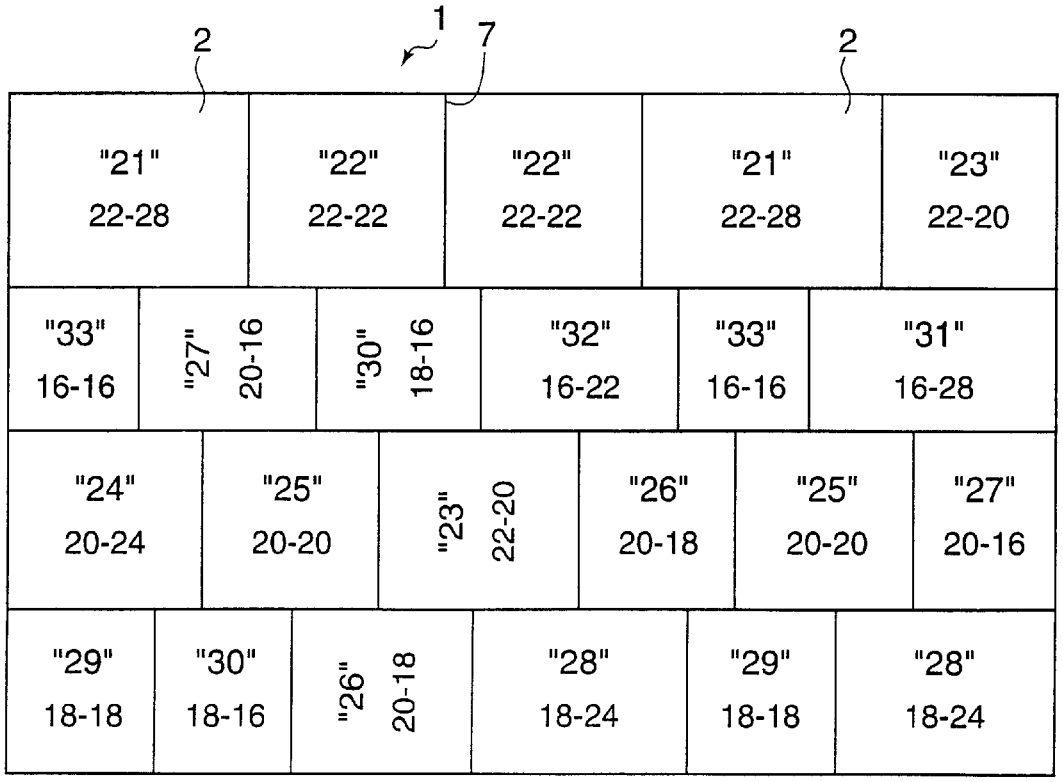
FIG. 8 is a bottom view of a construction kit of another embodiment, (core concrete side), schematic view.

The construction kit 1 shown in FIG. 1 is formed by a number of paving stones 2 made of concrete material. FIGS. 2 and 3 show that the paving stones 2 are designed with a prismatic shape. These paving stones have a head-piece 2' with a waveline-shaped circumferential surface 3, and a base piece 2", which is provided in the circumferential surface 4 with a number of dome-like projections 5 or attachments. The dome-like projections 5 are formed on the base piece 2" over parts of the length of the circumferential surface with a spacing from each other. The paving stones 2 are arranged in rows for forming the construction kit 1, as shown in FIG. 1 and FIGS. 7 and 8, whereby the paving stones 2 of each row are designed with the same width, but with identical or different widths. The lengths of the rows of paving stones of each construction kit 1 are overall designed according to a pattern which, according to FIGS. 7 and 8, is selected to measure, for example 1200 mm×760 mm. The raster measure of the construction kits can be selected in any other desired size. The construction kits 1 are formed as laying packets that can be safely seized and laid with the help of machines.

FIGS. 7 and 8 show the bottom views of the paving stones 2 referred to as the core concrete sides, which are assembled in rows of any desired length, but with identical widths to form a laying packet. The numerals 12 connected by the hyphens 11 represent measurement data in millimeters. In FIG. 7, the paving stones all having the same low width but different lengths are assembled to form a construction kit. In FIG. 8 the paving stones all have the same large width and different lengths are assembled to form a construction kit.

Figure 18:
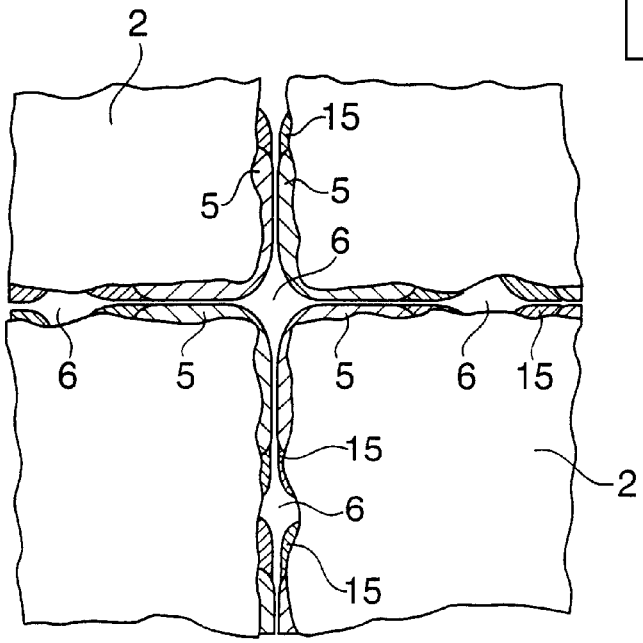
FIG. 18 is a top view of a partial piece of a construction kit.

The dome-like projections 5 on the circumferential surfaces 4 of the base pieces 2" form a laying packet, in construction kit 1 and mutually support adjacent paving stones 2, or rows of paving stones. By dimensioning the dome-like projections 5 accordingly, the latter permit the formation of passage openings 6 (FIG. 18) for water within the zones of the joints 7, via which water can drain off into the underground.

Figure 9:
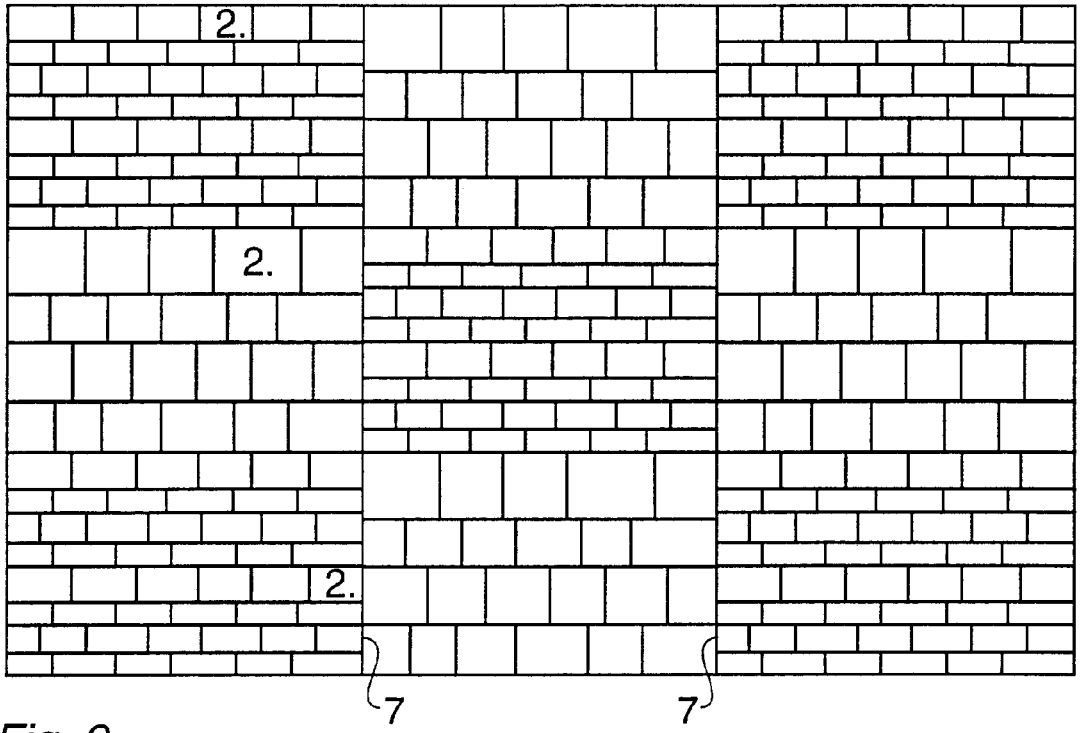
FIG. 9 is a schematic representation of a number of construction kits in a laid composite.
Figure 10:
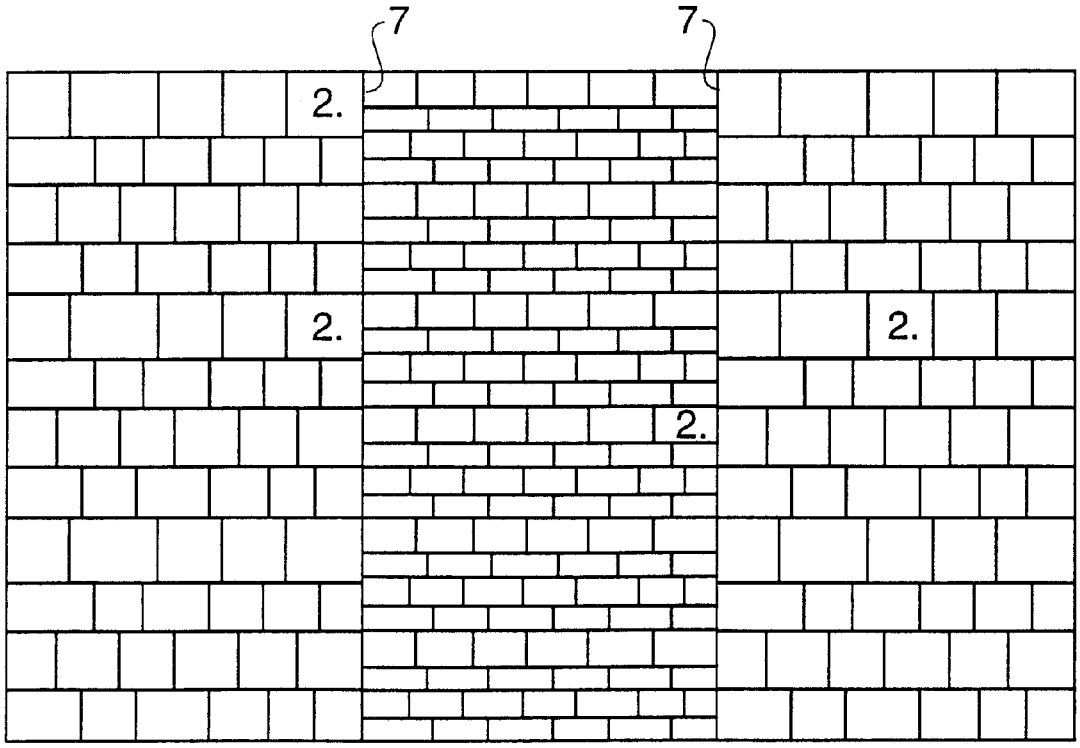
FIG. 10 is a schematic representation of a number of construction kits a modified laid composite.

In FIG. 9, the construction kits 1 conforming to the pattern in FIG. 7 are combined with construction kits 1 according to FIG. 8 to form a laying composite. These construction kits 1 in the laid composite show lines of continuous joints 7 in the transverse and longitudinal zones of adjacent construction kits 1. In FIG. 10, a modified laying composite is formed by combining construction kits of FIGS. 7 and 8. In connection with the laying composite too, there are through-extending joints in the transverse and longitudinal regions of adjacent construction kits. The construction kits 1 of the center zone of the laying composite in FIG. 10 correspond with the construction kit 1 of FIG. 7, and the two lateral sections of the laying composite correspond with the construction kits 1 of FIG. 8.

Figure 11:
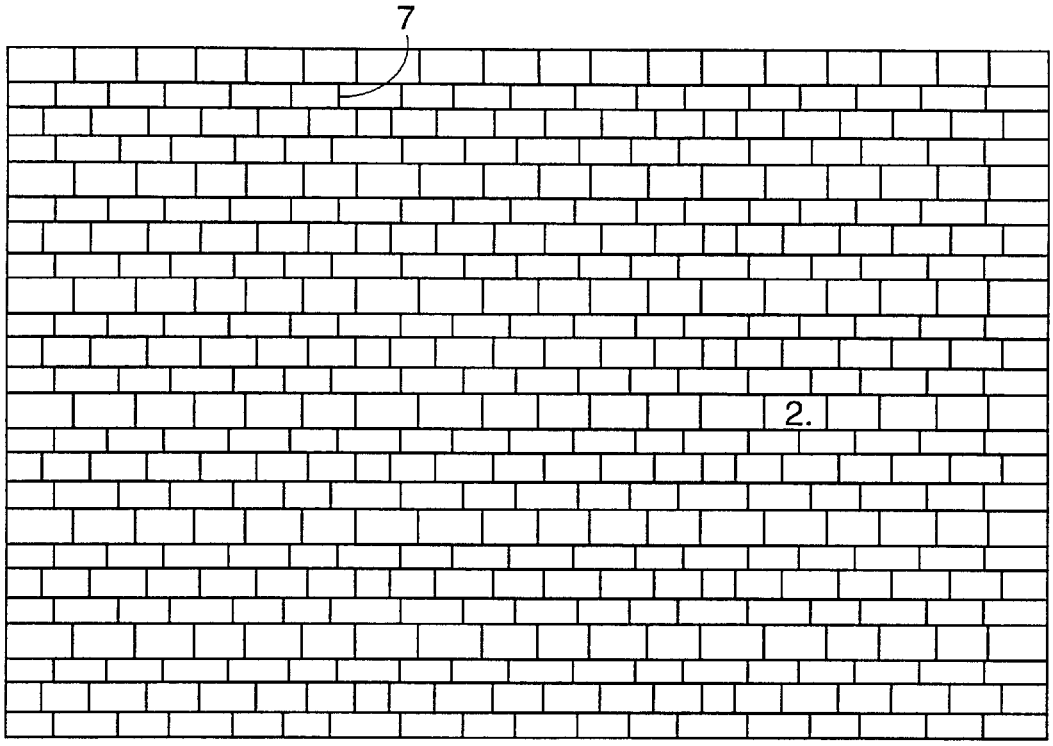
FIG. 11 is a schematic top view of a number of construction kits according to FIG. 1 in a laid composite, with replaced row end stones.
Figure 12:
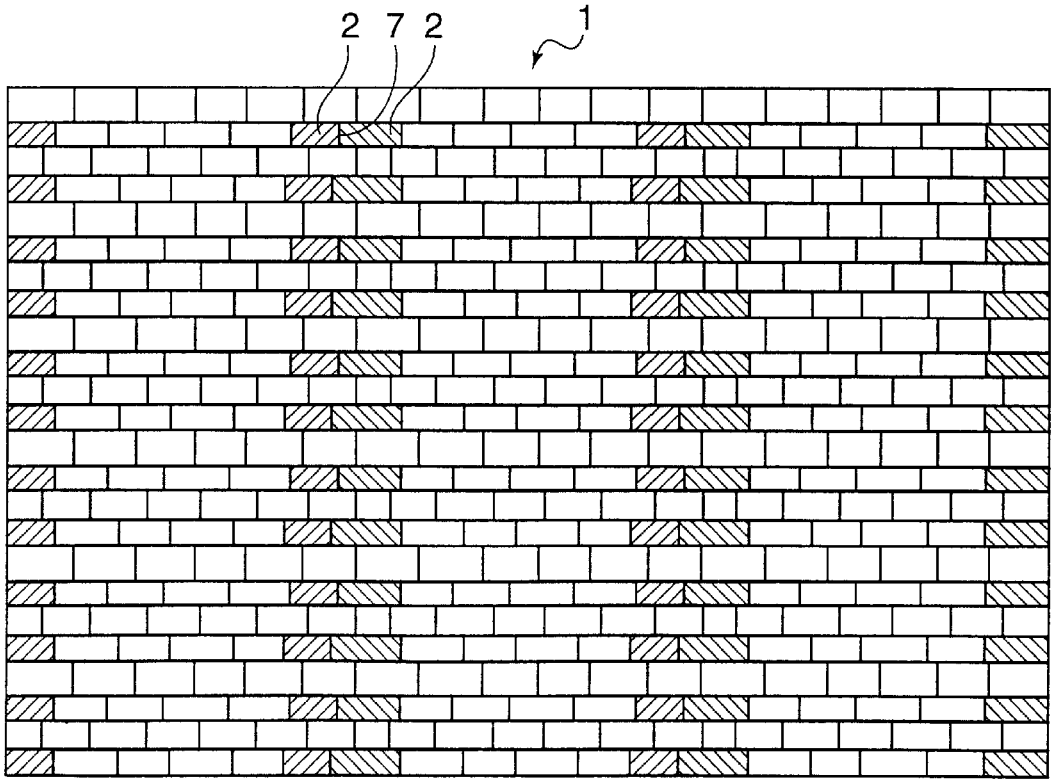
FIG. 12 is a laid composite according to FIG. 11 with row end stones marked for replacement.

FIGS. 11 and 12 represent a laying composite formed by the construction kits 1 of FIG. 7. In this connection, the construction kits 1 each are picked up by means of a machine in the form of a rectangular laying composite and then laid down. The laying pattern according to FIG. 11 is then obtained by subsequently replacing the row end stones 2 (shown by dashed lines in FIG. 12). Instead of the through-extending continuous joints 7, meander-shaped joints 7 are obtainable within the rows of the paving stones by replacing the dashed row end stones. A laying pattern that is continuously closed is obtained in this way.

Figure 13:
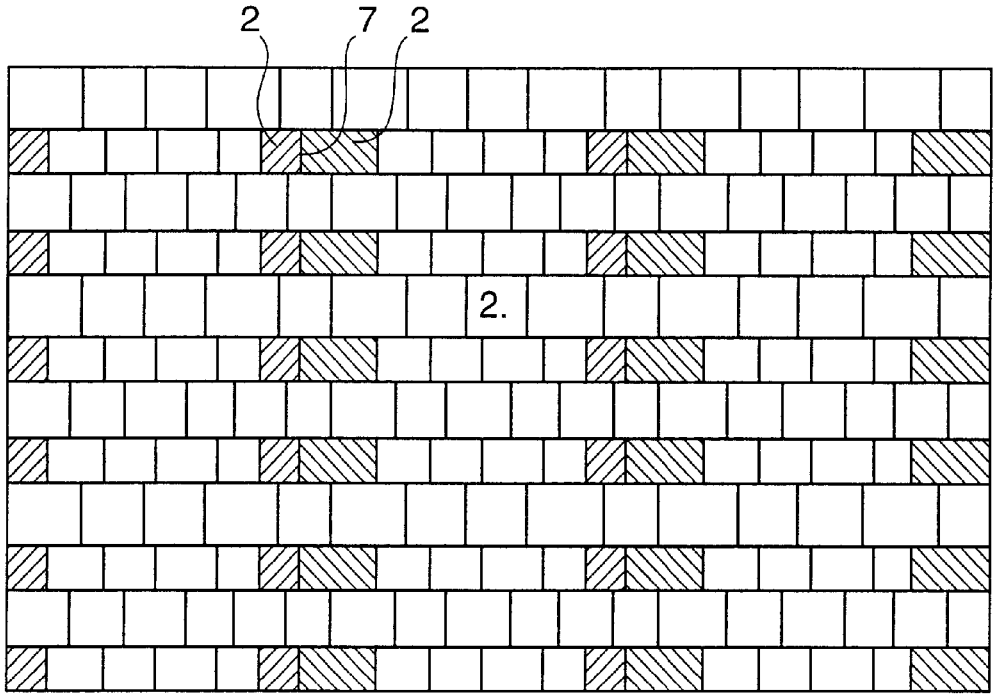
FIG. 13 is a schematic top view of a number of construction kits according to FIG. 8 in a laid composite.
Figure 14:
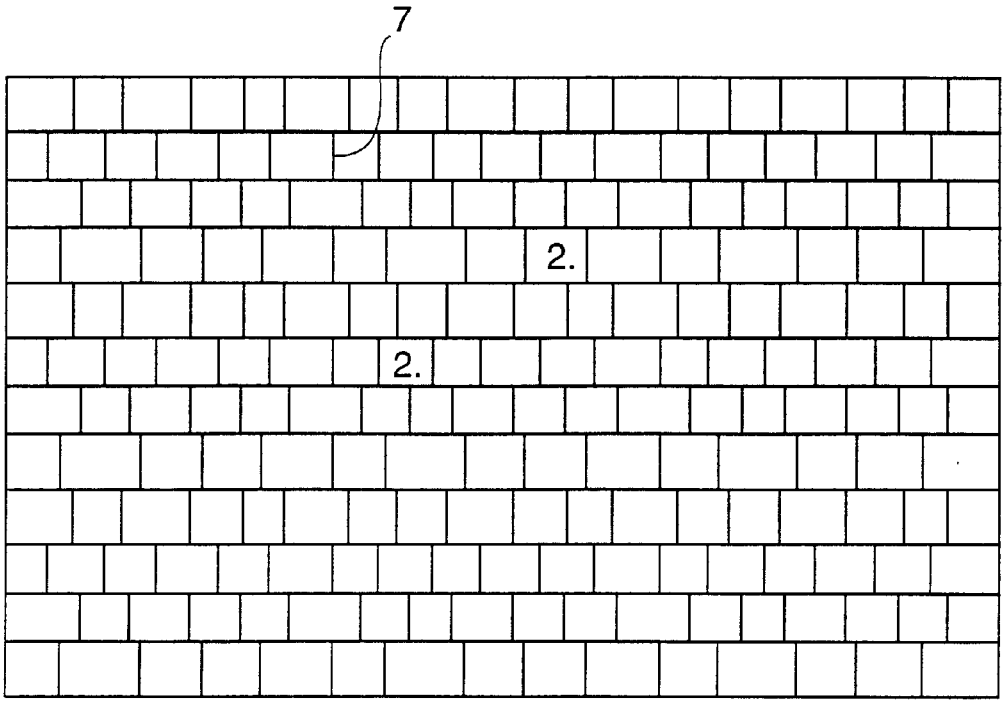
FIG. 14 is a laid composite according to FIG. 13 with row end stones marked for replacement.

The same considerations apply to the laying patterns of FIGS. 13 and 14. In the present laid composite, construction kits according to FIG. 8 are used, whereby a laying pattern of FIG. 14, with meander-like joints 7, is obtained. This occurs by exchanging paving stones at the ends of the rows of adjacent construction kits 1 (shown in the exemplified embodiment by dashed lines), the laying pattern of FIG. 14 being closed within itself. It is not possible for the viewer to recognize That the laid composite is created with a number of construction kits laid by a machine.

Figure 15:
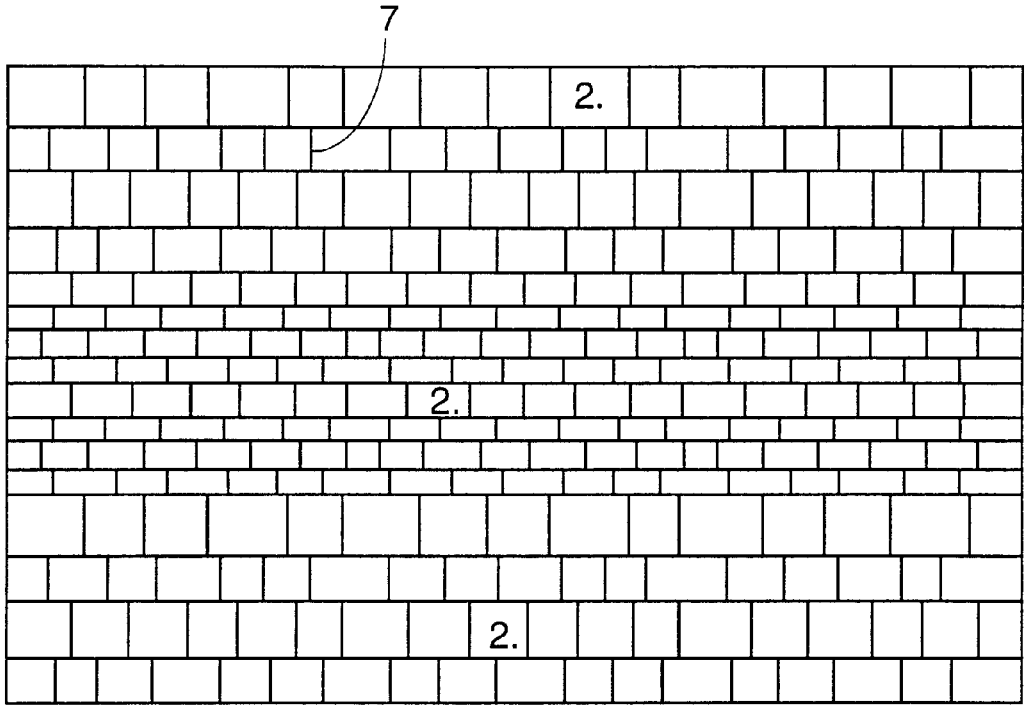
FIG. 15 is a schematic top view of a number of construction kits according to FIGS. 7 and 8 in the laid composite.
Figure 16:
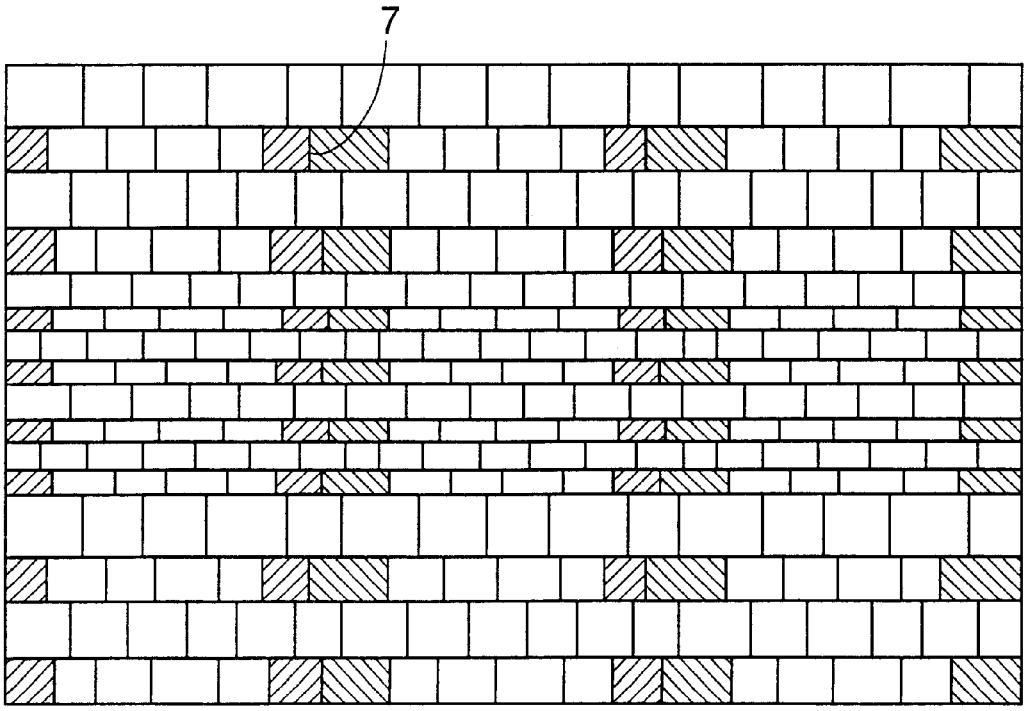
FIG. 16 is a laid composite according to FIG. 15 with row end stones marked for replacement.

In the embodiment according to FIGS. 15 and 16, construction kits of FIG. 7 and FIG. 8 are employed next to each other. The joints 7 have a meander-like shape by replacing end stones of the rows (shown dashed in FIG. 16).

Figure 5:
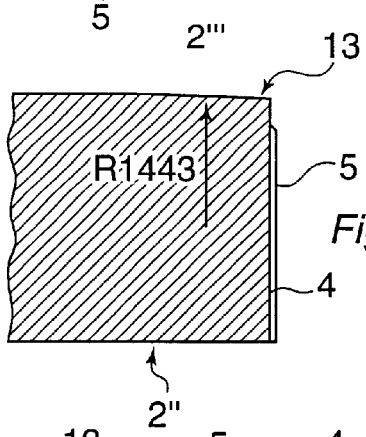
FIG. 5 is a section according to line V—V in FIG. 4.
Figure 4:
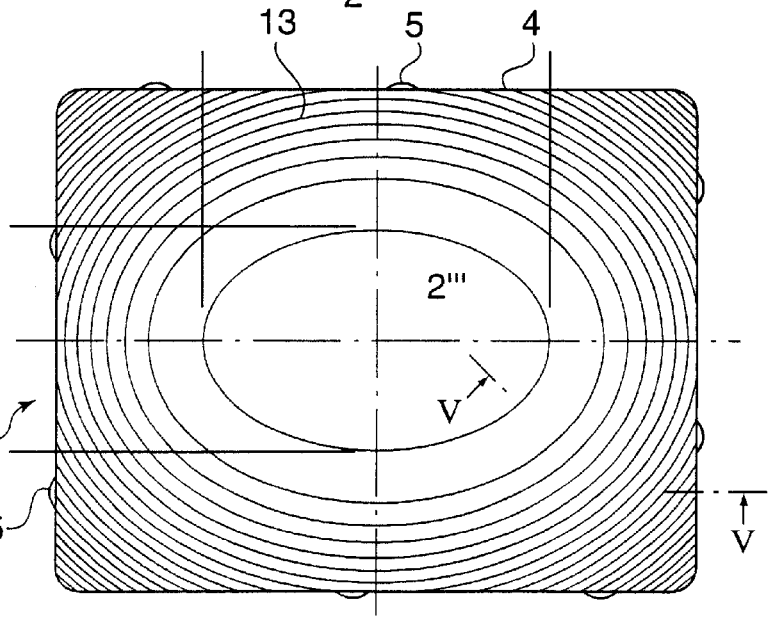
FIG. 4 is a top view of a paving stone of a modified embodiment.

Deviating from the above, FIGS. 4 and 5 show a paving stone 2 for a construction kit 1 which, instead of the head pieces 2' being defined by a wavy line, has the head pieces 2' with the rectangular shape. In this case, the base pieces 2", in the laid condition, have attachments 5 for creating water passage openings 6 in the circumferential surfaces 4.

It was found to be advantageous if the paving stones 2 have the outwardly extending dome-like projections within the zone of their top sides 2"', as it is shown particularly in FIGS. 4 and 5. The dome-like projections 13 have a radius of about 1443 mm. From a top view, paving stones 2 with large surface areas have the relatively flat dome-like projections 13. These paving stones 2 with small cross section sizes have the dome-like projections 13 with a strong curvature.

Figure 6:
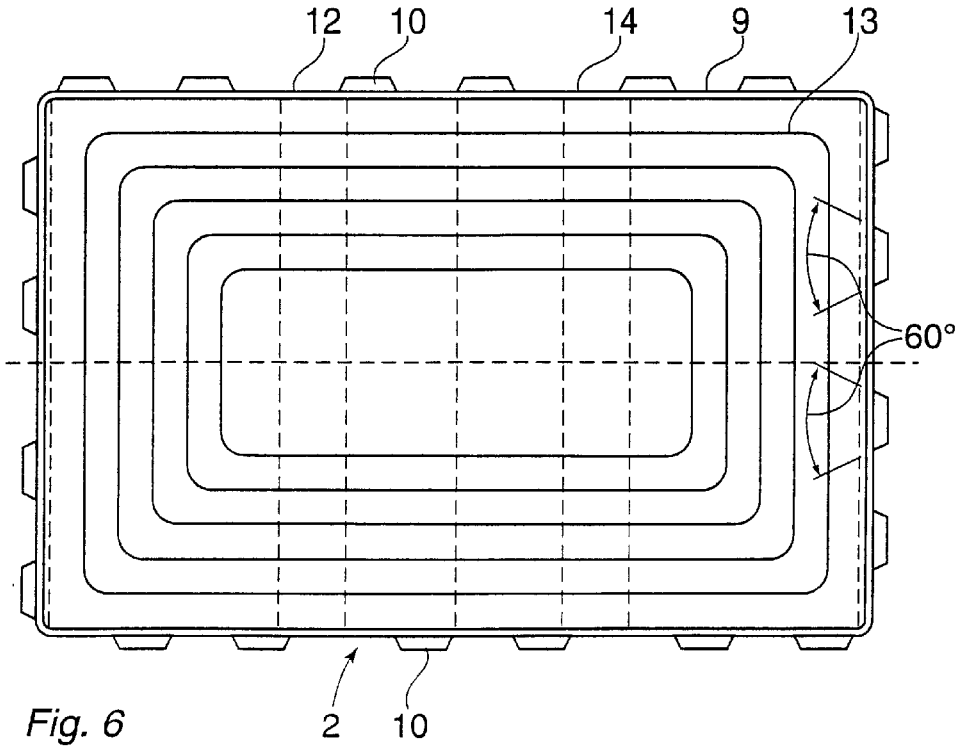
FIG. 6 is a top view of another paving stone.

FIG. 6 shows another paving stone 2 by a top view. The paving stone has side surfaces 14 with parallel faces, the surfaces supporting rib-like attachments 5 that are spaced apart from each other. The attachments 5 serve as spacer means versus adjacent paving stones and for forming water passage openings within the areas of the joints. In the present embodiment, too, the top side of the paving stone 2 has an outwardly pointing dome-like projection 13.

Figure 17:
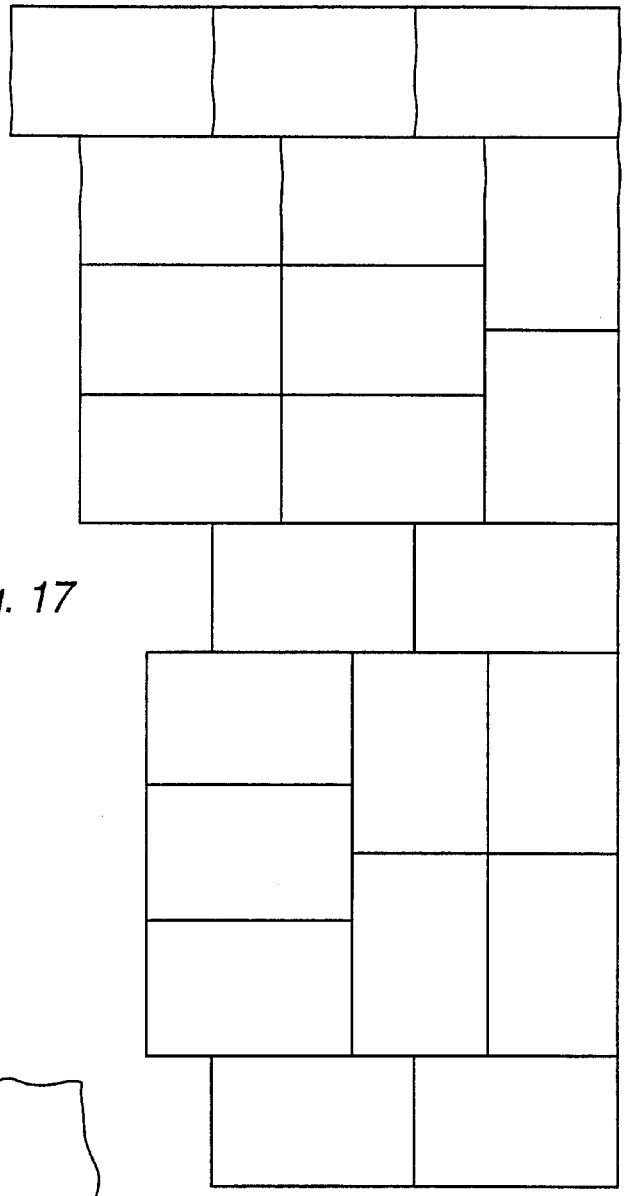
FIG. 17 is a schematic top view showing by way of example a laying composite with construction kits.

FIG. 17 shows a laying pattern such that a laying pattern that is closed within itself can be obtained without requiring any replacement of end stones of the rows by associating the construction kits 1 with each other in a suitable way.

Accordingly, while several embodiments of the present invention have been shown and described, it is to be understood that many changes and modifications may be made thereunto without departing from the spirit and scope of the invention as defined in the appended claims.

What is claimed is:

1. A construction set of paving stones forming rows wherein the paving stones are made of concrete material, and wherein the paving stones form a mechanically engageable laying set, wherein each of the paving stones comprises:

a) a bottom surface;

b) a plurality of circumferential surfaces comprising:

i) a base part having a plurality of projections formed as irregular dome like projections disposed adjacent to each other with a spacing in between; and ii) a head part disposed adjacent to said base part and having a waveline shaped outer surface wherein said circumferential surfaces are coupled to said bottom surface; and c) a top surface comprising:

i) a substantially dome like projection; and ii) at least one flat central upper region surrounded by said substantially dome like projection wherein said at least one flat central upper region has an even surface allowing the paving stones to be positioned one on top of the other, wherein said top surface is coupled to said plurality of circumferential surfaces, and wherein when the paving stones are placed adjacent to each other in the construction set, said irregular dome like projections on said base part form passage openings allowing water to drain through.

2. The construction set according to claim 1, wherein said head part and said base part both have broken or rounded corners or edges.

3. The construction set according to claim 1, wherein the paving stones have different lengths so that when the paving stones are stacked adjacent to each other, gaps between the paving stones form a series of meandering lines.

4. The construction set of paving stones as in claim 1, wherein said head part is formed by a symmetrical concentric curve extending around a top part of the paving stones.

5. A construction set of paving stones forming rows wherein the paving stones are made of concrete material, and wherein the paving stones form a mechanically engageable laying set, wherein each of the paving stones comprises:

a) a bottom surface;

b) a plurality of circumferential surfaces comprising:

i) a base part having a plurality of projections formed as irregular dome like projections disposed adjacent to each other with a spacing in between; and ii) a head part disposed adjacent to said base part and having a waveline shaped outer surface wherein said circumferential surfaces are coupled to said bottom surface; and c) a top surface comprising;

i) a substantially dome like projection; and ii) at least one flat central upper region surrounded by said substantially dome like projection wherein said at least one flat central upper region has an even surface wherein the paving stones are stacked one on top of the other, wherein said top surface is coupled to said plurality of circumferential surfaces, and wherein when the paving atones are placed adjacent to each other in the construction set, said irregular dome like projections on said base part form passage openings allowing water to drain through.

* * * * *